US005543769A

United States Patent [19]

Goren et al.

[11] Patent Number: 5,543,769

[45] Date of Patent: Aug. 6, 1996

[54] FAST SUPERCONDUCTING MAGNETIC FIELD SWITCH

[75] Inventors: Yehuda Goren, Mountain View, Calif.; Narayan K. Mahale, The Woodlands, Tex.

[73] Assignee: The United States of America as represented by the Department of Energy, Washington, D.C.

[21] Appl. No.: 371,503

[22] Filed: Jan. 11, 1995

[51] Int. Cl.[6] ..... H01J 31/00

[52] U.S. Cl. ..... 335/216; 335/210; 335/301; 313/479

[58] Field of Search ..... 335/210–214, 335/216, 301; 250/396 R, 396 ML; 313/421, 426, 427, 433, 440, 477, 479, 160, 161, 567; 315/8, 85; 324/318, 319, 320

*Primary Examiner*—Leo P. Picard
*Assistant Examiner*—Raymond M. Barrera
*Attorney, Agent, or Firm*—Bradley W. Smith; Hugh Glenn; William R. Moser

[57] ABSTRACT

The superconducting magnetic switch or fast kicker magnet is employed with a electron stream or a bunch of electrons to rapidly change the direction of flow of the electron stream or bunch of electrons. The apparatus employs a beam tube which is coated with a film of superconducting material. The tube is cooled to a temperature below the superconducting transition temperature and is subjected to a constant magnetic field which is produced by an external dc magnet. The magnetic field produced by the dc magnet is less than the critical field for the superconducting material, thus, creating a Meissner Effect condition. A controllable fast electromagnet is used to provide a magnetic field which supplements that of the dc magnet so that when the fast magnet is energized the combined magnetic field is now greater that the critical field and the superconducting material returns to its normal state allowing the magnetic field to penetrate the tube. This produces an internal field which effects the direction of motion and of the electron stream or electron bunch. The switch can also operate as a switching mechanism for charged particles.

25 Claims, 6 Drawing Sheets

FAST SUPERCONDUCTING MAGNETIC FIELD SWITCH

CONTRACTUAL ORIGIN OF THE INVENTION

The United States Government has rights in this invention pursuant to Contract No. DE-AC07-84ID12435 between the U.S. Department of Energy and Westinghouse Idaho Nuclear Company, Inc.

BACKGROUND OF THE INVENTION

Magnetic switches and particularly fast kicker magnets are used in the accelerator industry to quickly deflect particle beams into and out of various transport lines, storage rings, dumps, and specifically to differentially route individual bunches of particles from a train of bunches which are injected or ejected from a given ring. As a result, a kicker magnet or switch needs to possess accuracy, speed and reliability.

The current switches employed at the end of the high power pulse forming lines (PFL) are capable of delivering currents at rates of 100–200 amp/nsec. These switch response speeds pose a limitation on the response time of the kicker magnet. The current kicker magnets, also, have stray inductance, stray capacitance and mutual inductances which produce significant dispersive effects to the high harmonic frequency content of the desired kick pulse. These dispersive effects limit the magnet's rise and fall times.

Most of the conventional kicker magnets employ a high permeability ferrite to concentrate the magnetic fields. However, high permeability ferrites tend to be more lossy and have a poorer high frequency response. These conditions result in a longer rise and fall time of the magnetic field as well as heating problems within the ferrites.

As a result, the main sources of inaccuracies associated with the current kicker magnets are: magnet transient time, impedance mismatches and pulse distortion at the switches. As a result of the relatively slow rise times and the inaccuracies of currently operational kicker magnets, high energy beam particles end up hitting the walls of the kicker magnet as well as the walls of the beam transport line. This produces a highly radioactive environment. In such an environment, the magnet's experience radiation damage to their insulation reducing their reliability and life time.

In addition to their deficiencies in accuracies, speed, and reliability, the present kicker magnets are bulky and require long interactive distances to deflect charged beams by an angle of a few milliradians. The present kicker magnets, also, require expensive high power supplies, as well as, high power electrical circuitry.

Applicants' invention is for a magnetic switch which can be employed as a magnetic kicker. The switch is comprised of a primary insulator tube coated with a film of superconducting material. The film may be coated on the inside surface of the insulator tube, on the outside surface of the insulator tube, or sandwiched interior to the surfaces of the insulator tube to protect it from ionized radiation. To provide the superconducting properties of the superconducting material, an integrated cooling system must be able to cool the insulator tube and the superconducting material to a temperature below the superconducting transition temperature. In an alternative embodiment, a secondary insulator beam tube is placed interior to the first tubing. This secondary beam tube is striped longitudinally with conducting material to provide a means of protecting the superconducting material when a stream of high energy charged particles transcends the tube. A magnetic field source system is placed external to the tubing.

In the preferred embodiment, the magnetic field source system is a strong dc magnet combined with a fast rise time secondary magnetic source. The dc magnet's magnetic field is oriented perpendicular to the axis of the beam tubing; however, for applications other than that of a kicker magnetic switch, the orientation may differ from the perpendicular. The strong dc magnet is selected to provide a magnetic field just below the value for critical field, thus, according to the Meissner Effect the magnetic field interior to the superconductor coated insulator tube the magnetic field is zero. When activated, the magnetic field of the fast magnet combines with the magnet field of the dc magnet to increase the magnetic field to a value, depending on the superconducting material, which exceeds the critical value, thus, allowing the combined magnetic field to penetrate the tube.

When subjected to a magnetic field, the specific properties associated with the superconductor film dictate a value for a critical magnetic field associated with the film. The critical field depends on the film thickness, the film material, its critical temperature, the field orientation, and the operating temperature of the device. For magnetic fields below this critical field value, the interior of the beam tubing, as noted earlier, is isolated from the external magnetic field due to the Meissner Effect. However, if using the fast rise time magnetic field source, the external magnetic field is increased to a value greater than the critical magnetic field a phase transition occurs in the superconducting material reverting it to its normal state. In this normal state, the magnetic field diffuses in an extremely short time through the film and the insulator tube to establish a magnetic field in the tube. If the magnetic sources create a field perpendicular to the axis of the tube, the field developed when the film is in the normal state will have a field :interior to the tube which has an orientation perpendicular to the axis of the tube. In an alternate variation, the superconducting coated tube can be ellipsoid in shape to enhance the magnetic field parallel to the superconducting surface. Also, the switch or kicker magnet may be operated at different temperatures for different magnetic field requirements. The strength of the magnetic field employed can be altered by changing the superconducting material used, changing the orientation of the external magnetic field or fields, or by using a combination of different superconducting materials; in addition, the operating speed of the switch will be determined by the speed of the fast magnet and the properties of the tube and the superconducting film.

Thus, Applicants' magnetic switch or kicker magnet is based on the magnetic quenching of a superconducting beam pipe where prior to quenching the external magnetic field, which is perpendicular to the beam axis, does not penetrate the beam pipe because of the Meissner Effect. As the external magnetic field increases in strength beyond a critical limit, a fast transition to a normal metallic phase occurs, the Meissner Effect disappears, and the external magnetic field penetrates the interior of the beam pipe. Thus, in this case the magnetic diffusion time, is the prime factor in determining the rate of magnetic field increase inside the tube.

In one embodiment of Applicant's invention, the beam pipe is a ceramic tube with good heat conduction characteristics such as BeO in order to reduce the thermal stresses in the pipe associated with the heat generated in the quenching process and to allow for better control of the cryogenic system; the tube is coated with a superconducting film such as Nb. A cooling system is then coupled to the coated tubing to reduce and retain the temperature of the tube at a few degrees Kelvin which is below the superconducting transition temperature for the specified superconducting material. A magnetic field source is positioned externally to the tube. The magnetic field source is comprised of a strong dc magnet having a magnetic field perpendicular to the axis of the beam tube; this is coupled with a relatively low power short rise time electromagnet source. The short rise time magnet may be either internal to cooling apparatus or external to the cooling apparatus if the intervening material associated with the apparatus does not effect the penetration of the magnetic field of the fast magnet. The strong dc magnet provides a magnetic field of field strength just below the critical field strength while the fast magnet serves to increases the field beyond the critical field strength. Thus, initially, a magnetic field is set-up in the film superconducting material just below the critical field strength, thus, producing a Meissner Effect and the lack of a magnetic field within the beam tube. The required magnitude of this field, which produces the Meissner Effect, depends on the film thickness, the film material, its temperature and the field orientation. For magnetic fields below this critical value the superconductor is in its shielding state, and the beam is isolated from the external magnetic field. However, a small increase in the external field brought on by the fast rise time magnetic field source, causes the superconducting material to transform to the normal state. At this stage the magnetic field diffuses in extremely short time through the thin film to establish a strong magnetic field at the center of the beam tube with an orientation perpendicular to the axis of the tube. An estimate of the diffusion time through the superconducting film in the normal state is given by $\tau=\pi\mu_0\Delta^2\sigma$ where $\Delta$ is the film thickness and $\sigma$ is the conductivity of the superconductor. From this equation we estimate the diffusion time for Nb to be 8.2 ns in a Nb film 7 μm thick at a temperature of 4K.

In the alternative, if the electron stream is not present in the tube the present apparatus can be used to provide a magnetic field at specified time internals through the use of the fast magnet. Further, the orientation of the external magnets can be oriented outside the plan of the perpendicular to provide for variations in the magnetic field orientation within the tube and the dc magnet can be replaced by alternate magnetic source which provides a stable magnetic field over time.

It is the object of the present invention to provide a superconducting magnetic switch or kicker magnet which has a very fast response time. Another objective of this invention is for a switch or kicker magnet which has low electrical requirements. Finally, it is an objective of this invention to provide a switch or kicker magnet which is simply constructed and compact in size.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of instrumentation and combinations particularly pointed out in the appended claims.

SUMMARY OF THE INVENTION

To achieve the foregoing and other advantages, this invention, a superconducting magnetic switch or fast kicker magnet, is based on the Meissner Effect as applied to a beam tube coated with a film of superconducting material. Initially, the strength of the magnetic field external to and interacting with the beam tube is less than the critical magnetic field and the external magnetic field, which is perpendicular to the beam axis, does not penetrate the beam pipe due to the Meissner Effect. As the external magnetic field increases beyond the critical limit due to the effect of an added fast controllable magnet, a fast transition of the superconducting material to the normal metallic phase occurs, the Meissner Effect disappears, and the magnetic field penetrates the beam pipe. As a result, the magnetic diffusion time through the coated beam tube is the prime factor in determining the rate of increase in the magnetic field in the interior of the tube. The presence of the magnetic field in the beam tube produces a deflection of the particle beam or of particle bunches within the beam, thus, forming a switching or kicker magnet system.

BRIEF DESCRIPTION OF THE DRAWINGS

The present invention is illustrated in the accompanying drawings where.

DETAILED DESCRIPTION OF THE INVENTION

Figure 1:
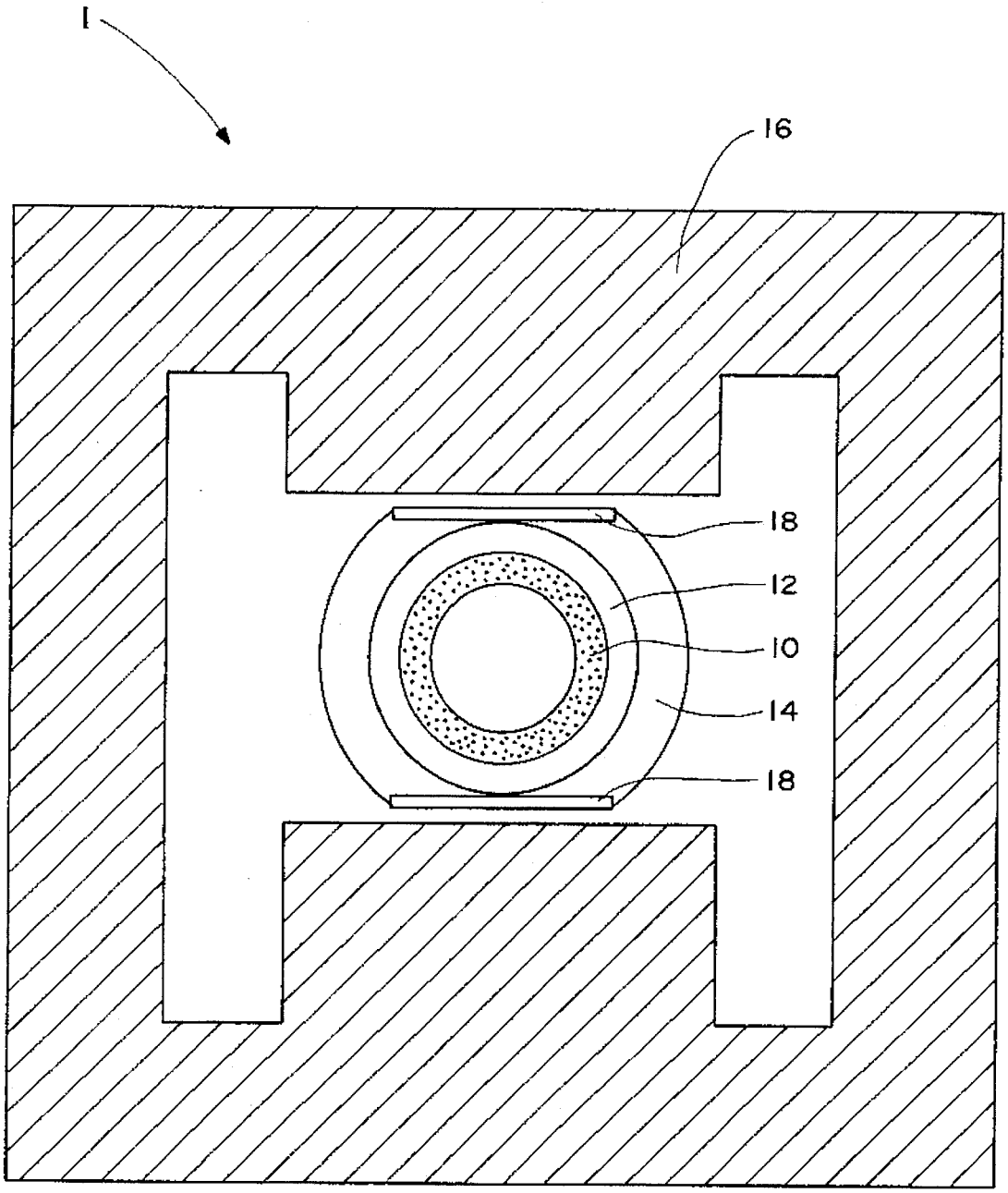
FIG. 1 depicts a cross-section of the kicker magnet system with the thin film of superconducting material exterior to the beam tube and the fast magnet internal to the cooling system.

As is illustrated in FIG. 1, the superconducting magnetic switch or fast kicker magnet system 1 comprises a beam tube 10 coated with a film 12 of superconducting material. The beam tube 10 is constructed of a material which is a poor electrical conductor to allow the magnetic field to penetrate the tube quickly once the superconducting film 12 is quenched. The tube 10 should have good thermal conducting properties and a large heat capacity to allow for the dissipation of the heat generated during quenching. A cooling system 14 surrounds the coated beam tube 10, 12 to lower the temperature of the coated tube to a temperature below the superconducting transition temperature. The specific temperature is dependent on the superconducting material selected. A dc magnet 16 surrounds the coated tube 10, 12 and is oriented so that its magnetic field is perpendicular to the axis of the beam tube 10. The magnetic field strength of the dc magnet 16 is selected to be just below the critical magnetic field for the superconducting material employed so as to produce a Meissner Effect with regards to the magnetic field interior to the tube 10. A low power, short rise time electromagnetic source 18 is oriented along the beam tube 10. Thus, when the electromagnetic source 18 is energized it produces a magnetic field which enforces the magnetic field of the permanent magnet 16 and eliminates the Meissner Effect. The fast magnet 18 is incorporated in the cooling system 14 in the preferred embodiment; however, if the penetration of the magnetic field is not inhibited by the cooling system 14 then the fast magnet 18 may be placed external to the cooling system 14 as is shown in FIG. 2.

Figure 2:
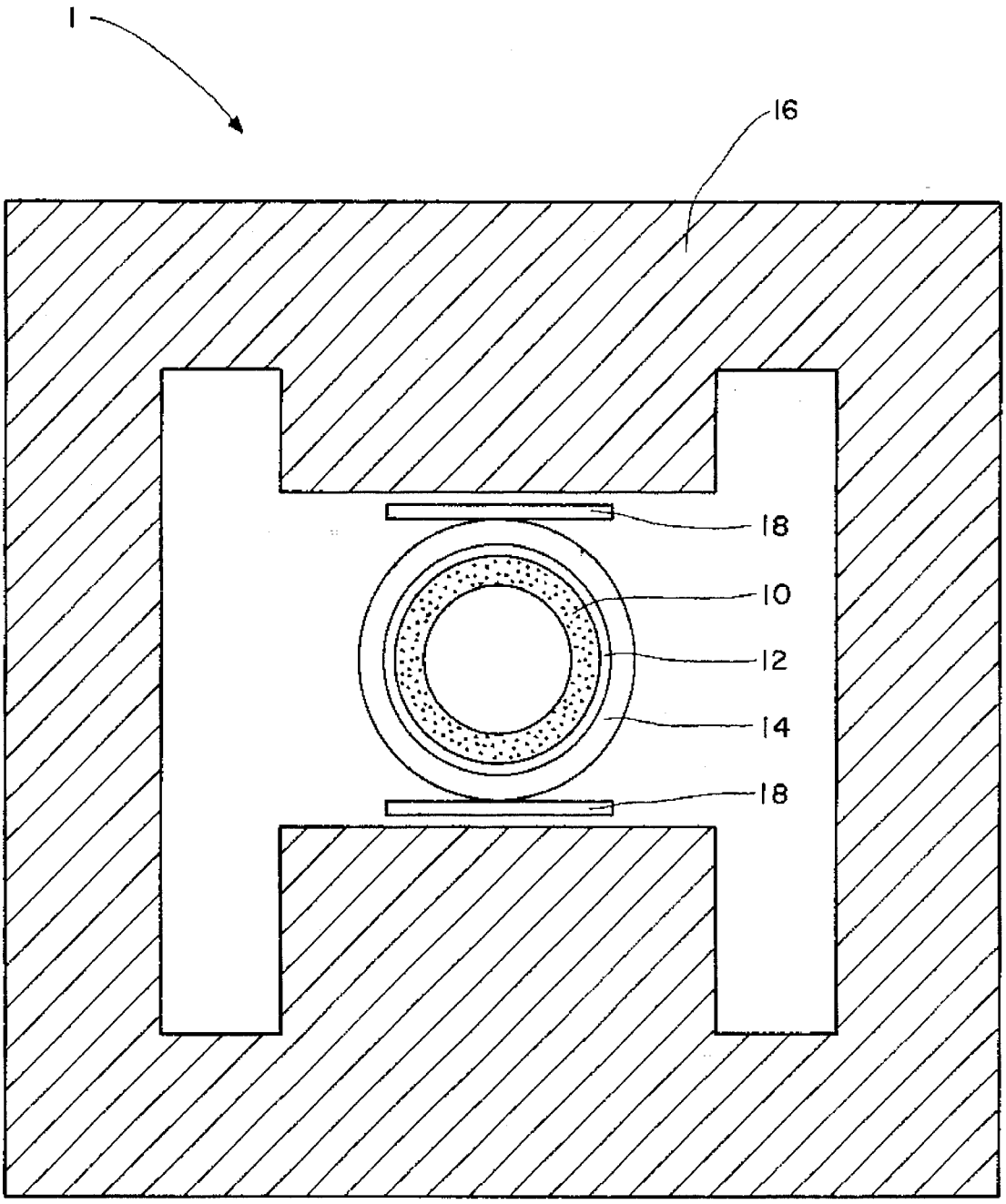
FIG. 2 depicts a cross-section of the kicker magnet system with the thin film of superconducting material exterior to the beam tube and the fast magnet external to the cooling system.
Figure 3:
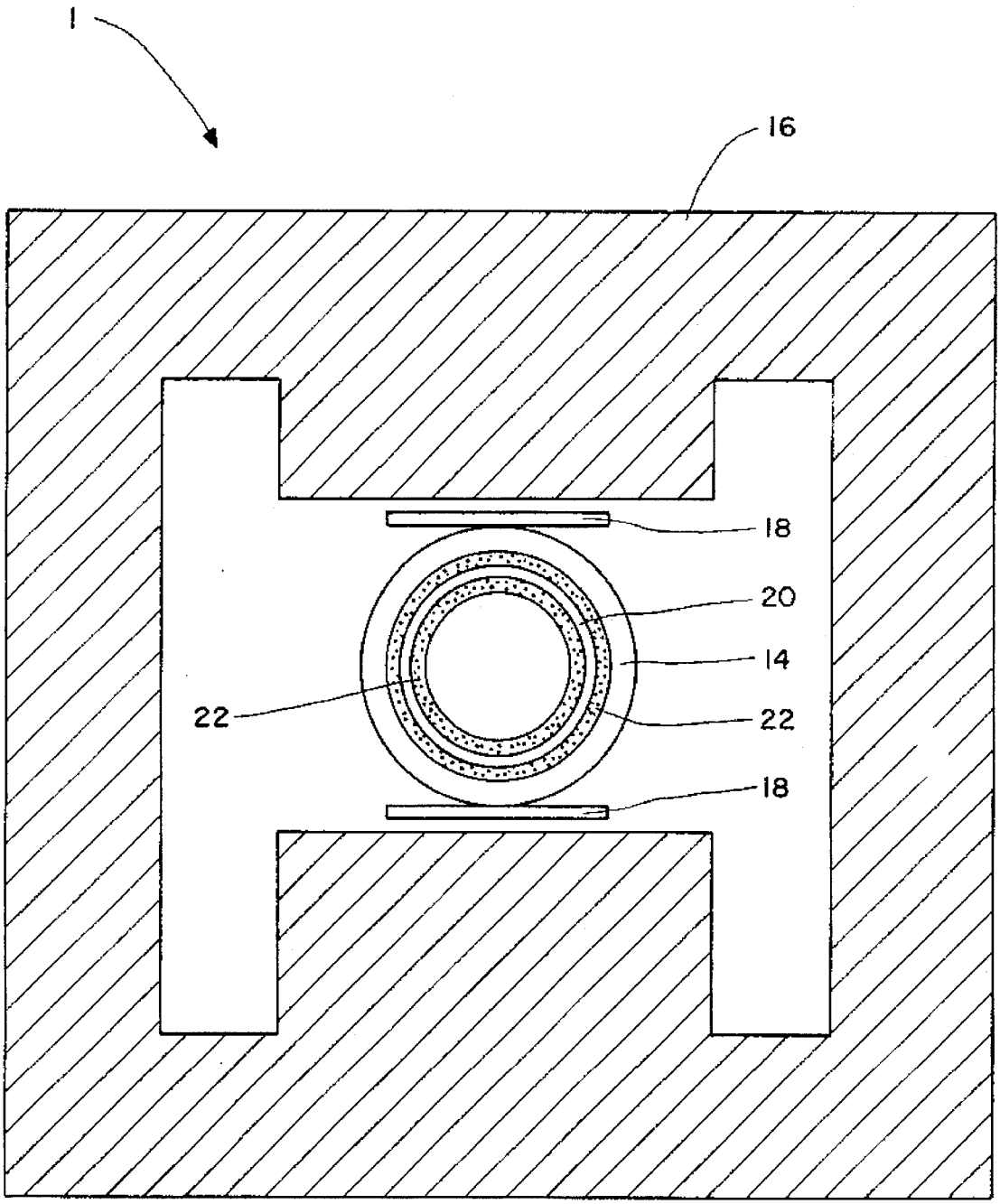
FIG. 3 shows a cross-section of the kicker magnet system with the thin film of superconducting material interior to the beam tube.

In FIG. 3, the apparatus is the same as FIG. 2 except the superconducting film 20 is positioned interior to the beam tube 22.

Figure 4:
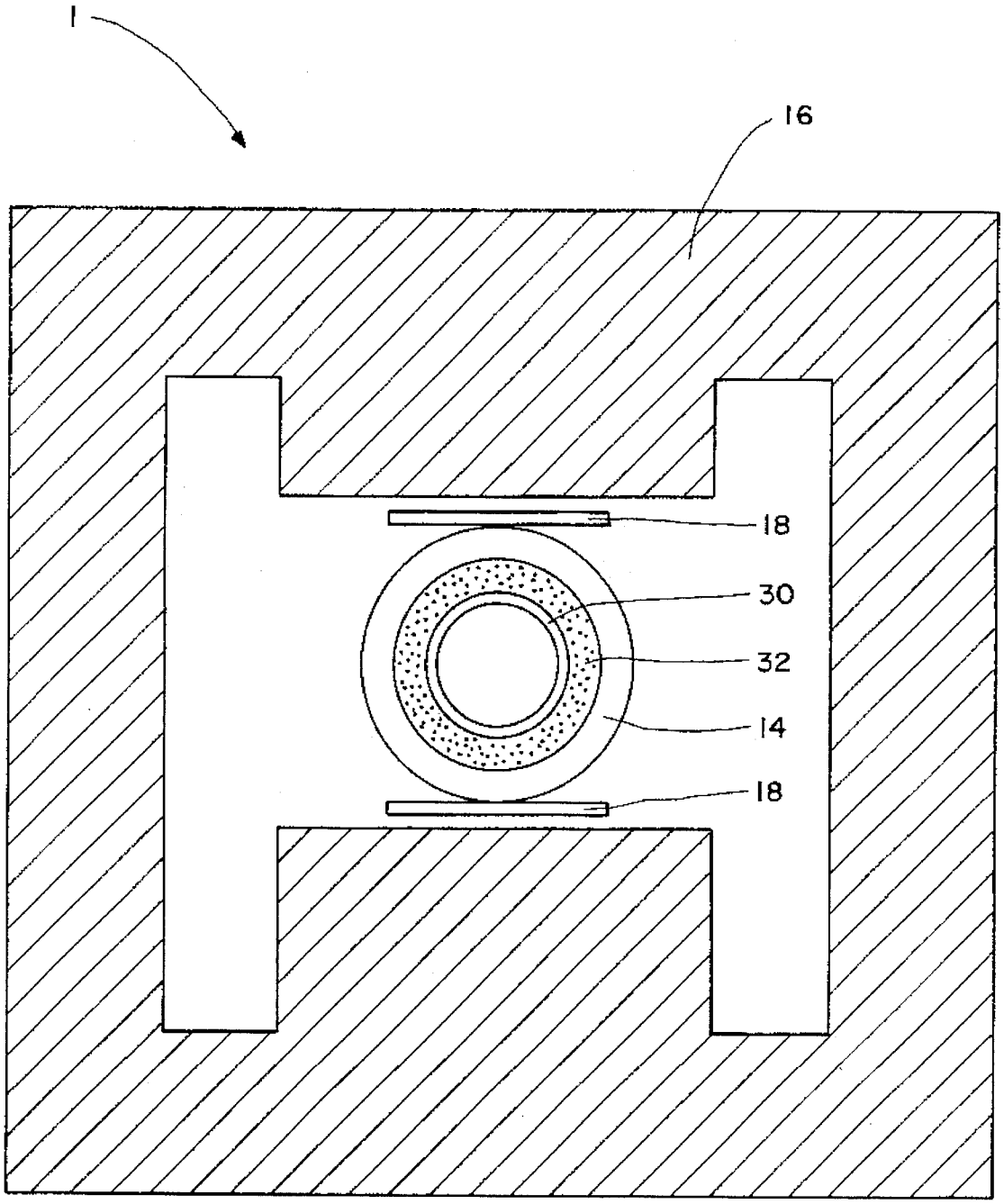
FIG. 4 illustrates a cross-section of the kicker magnet system with the thin film of superconducting material enclosed by the beam tube.

In FIG. 4, the apparatus is the same as FIG. 1 except the thin superconducting film 30 is located interior to the wall of the beam tube 32.

Figure 5:
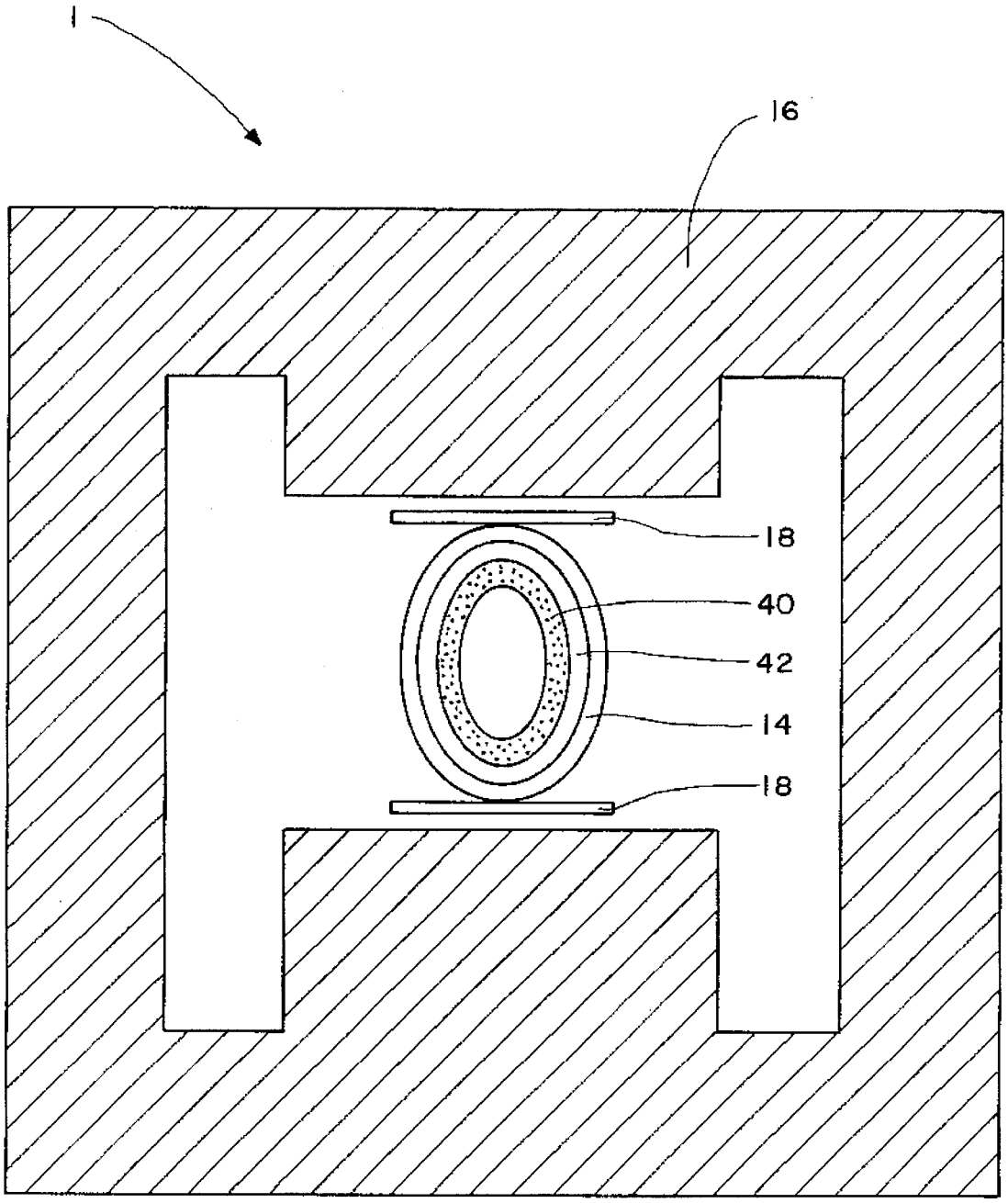
FIG. 5 shows a cross-section of the fast kicker magnet system where the beam tube is elliptical in shape.

FIG. 5, employs the same apparatus as FIG. 2 except that the beam tube 40 is elliptical in shape. The thin superconducting film 42 can be arranged in the same manner as for the previously described circular tube.

Figure 6:
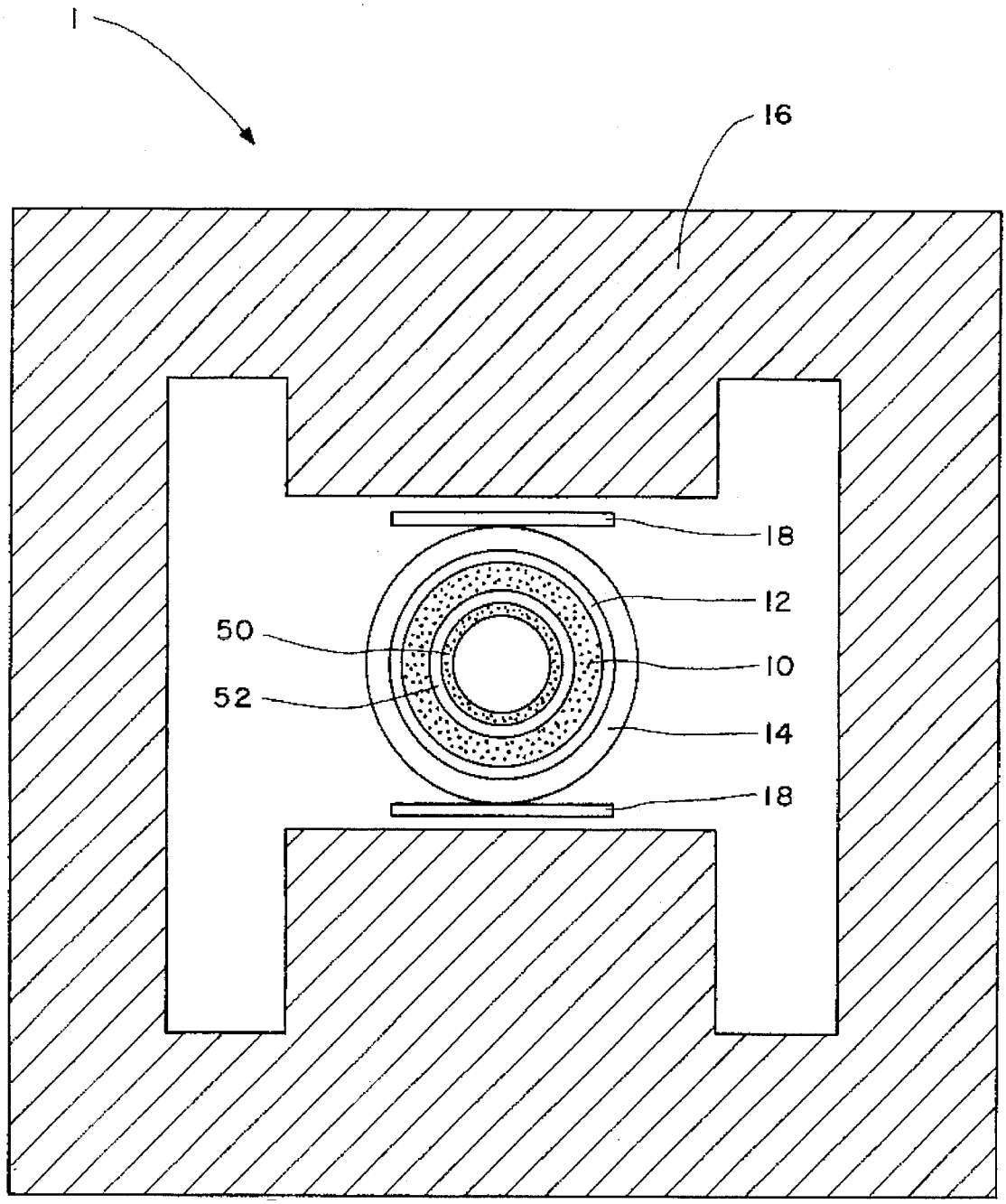
FIG. 6 is of an alternate embodiment with a secondary tube interior to the primary coated beam tube.

FIG. 6, adds an additional tube 50 which is coated with a conductive film 52 to the previously described apparatus. The purpose of this tube is to shield the superconducting material from the effects of the charged particle stream.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiments described explain the principles of the invention and practical applications and should enable others skilled in the art to utilize the invention in various embodiments and with various modifications as are suited to the particular use contemplated. It is intended that the scope of the invention be defined by the claims appended hereto.

The embodiment of this invention in which an exclusive property or privilege is claimed is defined as follows:

1. A superconducting magnet switch for controlling the motion of a system of charged particles, comprising:

a beam tube through which the system of charged particles travel;

a film of superconducting material which coats said beam tube;

a primary magnet external to said beam tube having a magnetic field strength less than a critical field strength associated with said film of superconducting material;

an electromagnet external to said beam tube which when energized produces a secondary magnetic field which interacts with said magnetic field of said primary magnet; and a cooling system to cool said beam tube and said superconducting film to temperatures where said film exhibits superconducting properties.

2. The system of claim 1 where said superconducting film is on the external surface of said beam tube.

3. The system of claim 1 where said superconducting film is on the internal surface of said beam tube.

4. The system of claim 1 where said superconducting film is sandwiched between the external and internal surfaces of said beam tube.

5. The system of claim 1 in which said primary magnet is a dc magnet.

6. The system of claim 2 wherein a tube coated with a conducting film is placed interior to said beam tube and where said system of charged particles now travels down said conducting film coated tube.

7. The system of claim 1 in which said beam tube is circular in shape.

8. The system of claim 1 in which said beam tube is elliptical in shape.

9. The system of claim 1 in which said primary and said secondary magnetic fields are perpendicular to said beam tube.

10. The system of claim 1 in which said primary magnet is a dipole magnet.

11. The system of claim 1 in which said primary magnet is a quadrupole magnet.

12. A method of altering the direction of flow of a stream or bunch of charged particles including:

cooling a beam tube of a specified shape and coated with a superconducting film to a temperature below its superconducting transition temperature so that said film exhibits superconducting properties, orienting a primary magnet relative to the beam tube in such a manner as to deflect the particles in a desired direction if a field associated with said primary magnet penetrates said beam tube where said primary field is below a critical field strength necessary to penetrate said coated beam tube, orienting a controllable fast magnet in a manner such that a magnetic field created by said fast magnet interacts with said primary magnetic field to exceed said critical field strength, thus allowing a combined magnetic field to penetrate said coated beam tube and interact with said particle stream.

13. The method of claim 12 including:

changing said shape of said beam tube to alter an interaction of said combined magnetic field on said particle stream.

14. A method of altering the properties of a stream or bunch of charged particles including:

cooling a beam tube of a specified shape and coated with a superconducting film to a temperature below its superconducting transition temperature so that said film exhibits superconducting properties, orienting a primary magnet relative to the beam tube in such a manner as to deflect the particles in a desired direction if a field associated with said primary magnet penetrates said beam tube where said primary field is below a critical field strength necessary to penetrate said coated beam tube, orienting a controllable fast magnet in a manner such that a magnetic field created by said fast magnet interacts with said primary magnetic field to exceed said critical field strength, thus allowing a combined magnetic field to penetrate said coated beam tube and interact with said particle stream.

15. The method of claim 12 including:

changing said shape of said beam tube to alter an interaction of said combined magnetic field on said particle stream or bunch or particles.

16. A superconducting magnet switch, comprising:

a tube;

a film of superconducting material which coats said tube;

a primary magnet external to said tube having a magnetic field strength less than a critical field strength associated with said film of superconducting material;

an electromagnet external to said tube which when energized produces a secondary magnetic field which interacts with said magnetic field of said primary magnet; and a cooling system to cool said tube and said superconducting film to temperatures where said film exhibits superconducting properties.

17. The system of claim 16 where said superconducting film is on the external surface of said tube.

18. The system of claim 16 where said superconducting film is on the internal surface of said tube.

19. The system of claim 16 where said superconducting film is sandwiched between the external and internal surfaces of said tube.

20. The system of claim 16 in which said primary magnet is a dc magnet.

21. The system of claim 16 in which said tube is circular in shape.

22. The system of claim 16 in which said tube is elliptical in shape.

23. The system of claim 16 in which said primary and said secondary magnetic fields are perpendicular to said tube.

24. The system of claim 16 in which said primary magnet is a dipole magnet.

25. The system of claim 16 in which said primary magnet is a quadrupole magnet.

* * * * *